United States Patent [19]

Palmaer et al.

[11] Patent Number: 4,556,121

[45] Date of Patent: Dec. 3, 1985

[54] HOLDER

[75] Inventors: Tore Palmaer, Postfach 100, CH-6340 Baar, Switzerland; Leif Palmaer, Kristinagatan 14, S-331 00 Värnamo; Björn Jacobsson, Bor, both of Sweden

[73] Assignees: Tore Palmaer, Switzerland; Leif Palmaer, Sweden

[21] Appl. No.: 584,641

[22] Filed: Feb. 29, 1984

[51] Int. Cl.[4] ..... H04R 25/00

[52] U.S. Cl. ..... 181/129; 179/156 R; 2/6; 2/423

[58] Field of Search ..... 181/128, 129, 137; 179/156 A, 156 R, 182 R; 2/423, 422, 424, 209, 6

[56] References Cited

U.S. PATENT DOCUMENTS

| | | | |
|---|---|---|---|
| 2,336,669 | 12/1943 | Brown et al. | 179/182 R X |
| 2,786,102 | 3/1957 | Frieder et al. | 179/156 R |
| 3,021,526 | 2/1962 | Lastnik | 181/129 X |
| 3,751,608 | 8/1973 | Weingartner | 179/156 R |
| 3,947,646 | 3/1976 | Saito | 179/146 R |
| 4,006,318 | 2/1977 | Sebesta et al. | 179/182 R X |
| 4,414,705 | 11/1983 | Ostrowsky | 16/225 |

FOREIGN PATENT DOCUMENTS

| | | |
|---|---|---|
| 321387 | 3/1975 | Austria . |
| WO82/03160 | 9/1982 | PCT Int'l Appl. . |
| 797059 | 6/1958 | United Kingdom . |

*Primary Examiner*—Russell E. Adams
*Assistant Examiner*—Brian W. Brown
*Attorney, Agent, or Firm*—Ostrolenk, Faber, Gerb & Soffen

[57] ABSTRACT

A holder is provided for securing a microphone or earpiece in position inside a helmet. The holder comprises a plurality of tubular rings of soft flexible material. One ring is adapted to be connected to a shell of the helmet, and the other rings are serially connected by resilient, short, thin, soft segments. The rings are dimensioned and arranged so that they can be nested within each other or pulled out to form an extending holder. A microphone or earpiece may be connected to one of the said rings.

8 Claims, 8 Drawing Figures

HOLDER

DESCRIPTION OF INVENTION

Figure 1A:
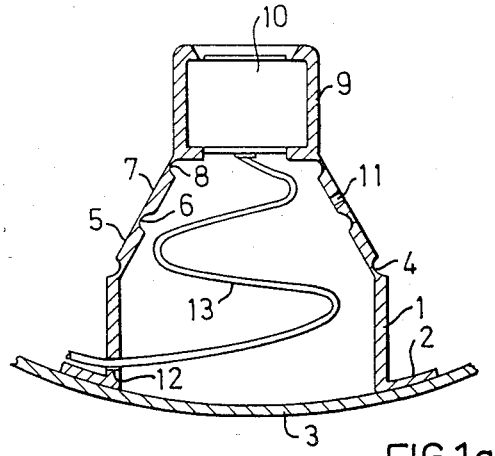

The present invention relates to a holder, more particularly relates to a holder adapted to hold a microphone and/or earpiece in position inside a helmet, in an earmuff or ear defender, or in a similar substantially rigid item of head gear.

Communication equipment comprising a microphone and/or one or more ear pieces, for example, are often used in helmets, or in other substantially rigid head gear. To ensure that such devices function in the intended manner, particularly when external noise has to be screened out, the microphone and/or each earpiece must be positioned at a specific predetermined distance in relation to the mouth or ear respectively. Where a helmet is provided with such devices, the distance between the shell of the helmet and the head of the wearer is different for different people, since people have faces of different shapes, and also have heads of different sizes. In order to locate each earpiece at the correct distance from the ear of the person utilising the helmet is has previously been proposed to locate a suitable insert between the shell and each earpiece to compensate for the different distances between the shell of the helmet and the ear or ears of people wearing the helmet. When the ear pieces have been mounted in such a way the helmet is only suitable for use by one person. Alternatively the appropriate compensation has been achieved by utilising springs which press the ear pieces against the ears of a person wearing the helmet. However, it has been found that it is unpleasant to have ear pieces pressed against one's ears by spring pressure over a long period of time, and this may also give rise to susurration and vibration. Attempts to mount a microphone on an adjustable arm within a helmet have also shown that it is difficult to produce a satisfactory arm which is sufficiently soft and small. If the arm is not soft and small it is possible that if the helmet is subjected to jolts whilst being worn, the arm may injur the face of a person wearing the helmet. Also, if the arm is too soft, there will be a vibration of the microphone with a resultant distortion of the speech signal generated by the microphone if the helmet is being used, for example, by a motor cyclist or rally driver.

According to this invention there is provied a holder for securing a microphone or earpiece inside a helmet, ear muff or the like, said holder comprising a plurality of tubular rings of soft flexible material, one ring being adapted to be connected to a shell of the helmet, ear muff or the like, the rings being serially connected by resilient, short, thin, soft segments, the rings being dimensioned and arranged so that they can be nested within each other or pulled out to form an extending holder, therebeing means to connect a microphone or earpiece to one of said rings.

Preferably the soft segments have different degrees of hardness, so that certain segments are folded or straightened out in a predetermined sequence when the holder is pushed into the nested position or pulled out to the extending position respectively.

Conveniently one or more of the rings is provided with acoustically active elements, such as a plurality of openings.

Advantageously means are provided for remotely controlling the extension of the holder.

Conveniently the holder is fabricated in one piece from a soft, flexible material, such as rubber.

The microphone or earpiece can be fitted in the end of the tubular holder that is adapted to be connected to the shell of the helmet or the like, or in one of the other rings of the holder. Where the microphone or ear piece is mounted in the ring of the holder that is adapted to be connected to the shell of the helmet or the like, when the holder is pulled out the tube defined by the holder serves as a sound-carrier. Where the microphone or earpiece is connected to a ring other than the ring that is connected to the shell of the helmet, the microphone or earpiece may be moved relative to the shell of the helmet so that the microphone or earpiece may be located in an appropriate position. If the microphone or earpiece is in an intermediate ring whilst the position of the microphone or earpiece may be adjusted, the tubular holder will still act, when fully extended, as a sound-carrying tube.

The rings may be made with a variable cross-section to provide a high transmission efficiency in the frequency range being used.

It will be appreciated that the above-mentioned acoustically active elements constituted by a plurality of openings in the holder allow sound to reach the rear of a microphone mounted in the ring furthest from the said one ring, thus reducing the action of the sound on the microphone membrane.

Figure 1C:
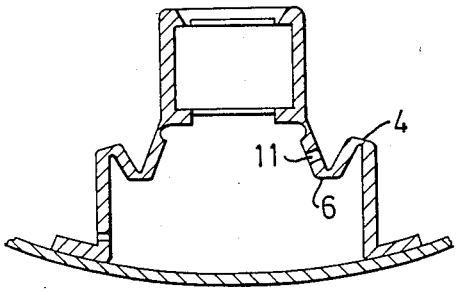
Figure 1B:
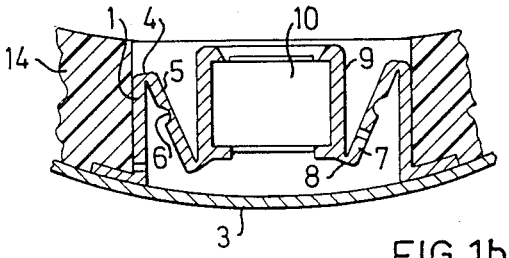
Figure 2A:
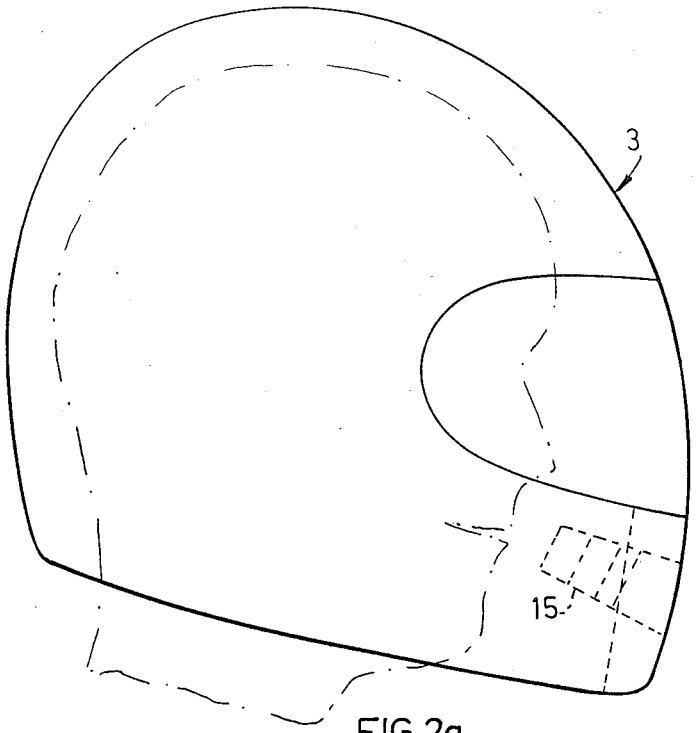
Figure 2C:
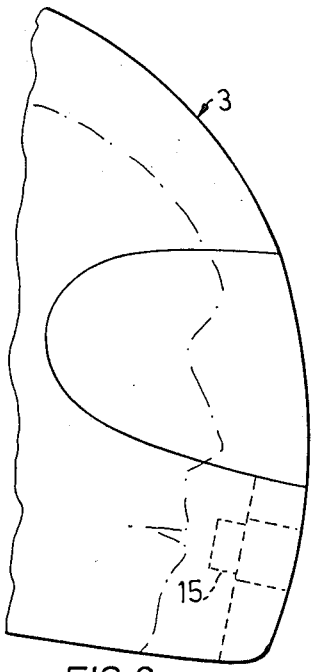
Figure 2B:
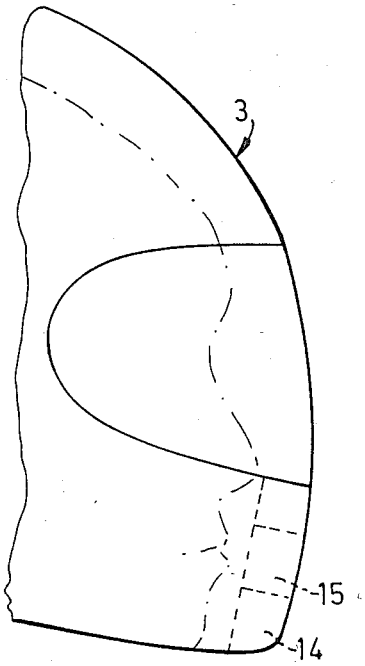
Figure 3:
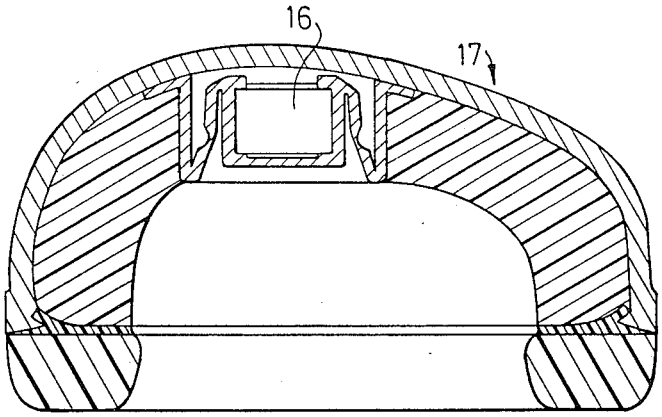
Figure 4:
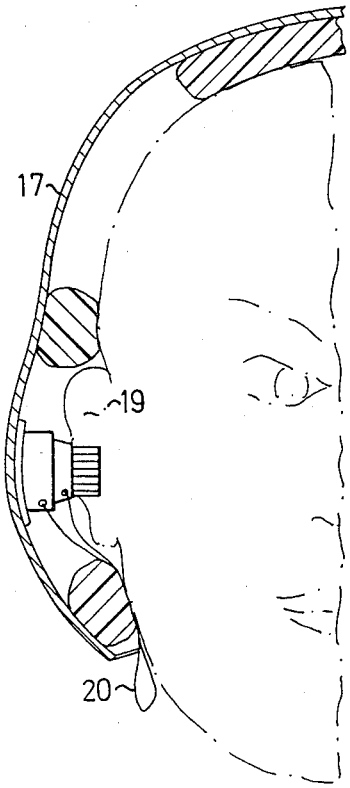

In order that the invention may be more readily understood, and so that further features thereof may be appreciated, the invention will now be described by way of example with reference to the accompanying drawings in which:

FIGS. 1*a* to 1*c* are cross sectional views illustrating a holder in accordance with the invention supporting a microphone in various alternative positions, FIGS. 2*a* to 2*c* are side elevational views (with FIGS. 2*b* and 2*c* being partly broken away) showing a helmet in which a microphone in accordance with the invention is mounted;

FIG. 3 is a cross sectional view of a holder in accordance with the invention fitted into the cup of an ear muff to hold an earpiece, and FIG. 4 is a part sectional view showing a further holder in accordance with the invention, with an earpiece, fitted into a flying helmet.

Referring initially to FIGS. 1*a* to 1*c* of the invention a holder in accordance with the invention is a substantially tubular holder. The holder comprises four principle integrated parts. The first part is a tubular attachment portion 1 having, at one end, a radially outwardly extending flange 2 adapted to be bonded or adhered to the shell, 3, of a helmet, for example. The holder may be attached to the helmet in the region of the chin protector. The other end of the tubular attachment portion 1 is connected, by means of a thin flexible segment 4 to the broad end of a conical ring shaped element 5. The narrow end of the conical ring shaped element 5 is joined by another flexible thin segment to another conical ring 7 which also tapers inwardly. The narrow end of the ring 7 is joined by a further flexible thin segment 8 to an annular part 9 of the holder, which is designed to hold a microphone 10. The ring 7 is preferably provided with noise-compensating apertures 11 and the tubular attachment portion 1 of the holder is provided with at least one aperture 12 to accommodate a connection wire leading to the microphone.

FIG. 1*a* shows the holder in a fully extended position, with the microphone being located at a maximum distance from the shell 3. FIG. 1*c* shows the holder in a partially compressed position, with the annular ring 5 being directed inwardly towards the flanged end of the tubular attachment element 1, the annular ring 7 still extending outwardly. FIG. 1*b* shows the holder in a fully compressed position, with both the annular rings 5 and 7 extending inwardly towards the flanged end of the tubular attachment element 1. The microphone is thus countersunk into a recess formed in the resilient padding 14 provided within the helmet. Only the resilient segments 4 and 8 are bent when the holder is in this position.

The thin segments 4, 6 and 8 are preferably made of different degrees of hardness so that when the microphone is pushed downwardly (when the holder is orientated as shown in FIGS. 1*a* to 1*c*) the segments flex in a set sequence, i.e. first segment 4 and segment 6 to provide the intermediate position shown in FIG. 1*b* and, after further compression of the holder, segment 6 and segment 8 to provide the fully compressed position as shown in FIG. 1*b*. All three positions of the holder are stable and serve to conduct less vibration to the microphone than other microphone attachment means of conventional design. In addition the holder of the present invention is extremely easy to adjust. The presently described embodiment of the invention has been found to be extremely suitable for use in various types of helmet, without requiring any modification of the helmets in question. Also, the embodiment is simple and cheap to manufacture. The holder may be made of rubber, or a soft plastics material, or any other combination of suitable material.

FIGS. 2*a* to 2*c* show a helmet 3 in which the microphone has been mounted by means of the holder as shown in FIGS. 1*a* to 1*c*. The three figures show the helmet being used by three different people each having a head of a different size and a face of a different shape. In the embodiment shown in FIG. 2*a* for example, the microphone holder, shown as 15 in the drawing, is in the fully extended position, and when in this position the microphone is located an appropriate distance from the lips of the person wearing the helmet. In FIG. 2*b* the microphone is in the fully compressed position, and again there is just a sufficient distance between the lips of the person wearing the helmet and the microphone. However, in the arrangement shown in FIG. 2*c* the holder is in an intermediate position and again the microphone is an appropriate distance from the lips of the person using the helmet. If the person wearing the helmet as illustrated in FIG. 2*a* or in FIG. 2*c* is involved in an accident, or if the helmet is provided with a sudden shock or jolt, the microphone will be pushed into the fully compressed position if the face of the person wearing the helmust moves towards the microphone. As can be seen from FIG. 1*b* the microphone is then surrounded by the padding material 14 provided within the helmet and thus the risk of the person wearing the helmet being subjected to facial injuries is minimised.

FIG. 3 illustrates a holder according to the invention holding an ear piece 16 in an ear muff 17. FIG. 4 illustrates a holder in accordance with the invention supporting an earpiece in a flying helmet 18.

It is to be noted that an earpiece should be located as close to the ear 19 of a person utilising the earpiece as possible so that the acoustic properties of the ear muff and helmet (i.e. the property of the ear muff and/or helmet to dampen the sound will not have a detrimental effect on the sound quality as heard by the ear of the person wearing the ear muff or helmet. It may be difficult to get the helmet over the ears of the person who is to wear the helmet without damaging or hurting the ears. To facilitate this a holder in accordance with the invention may be provided with a suitable mechanical arrangement, such as a pull string 20 or the like, enabling the holder to be located initially in a compressed position to enable the helmet to be easily located in position on the head of a person to wear the helmet, the string then being pulled to move the holder to a desired extended position holding the earpiece in a desired position relative to the ear. Alternatively the arrangement may be magnetically operated.

Since all the protruding parts of the preferred holder in accordance with the invention are made of a soft material, should a person wearing a helmet or ear muff provided with an earpiece supported by such a holder be subjected to jolts or blows, there is only a minimal risk that the earpiece will injur the person wearing the helmet or earphones. A similar consideration applies, as described above, to the location of microphones. Thus the present invention provides a holder that may be safe in use, but which can be easily adjusted to locate a microphone and/or earpiece in a desired position relative to the head of a person wearing a helmet or ear muff in which the holder is fitted.

The invention is not limited to the embodiments of the holder shown in the accompanying drawings as described above, since many modifications may be effective without departing from the scope of the invention. For example, the tubular rings may have a cross sectional shape other than the circular shape shown, i.e. they may have rectangular collar square or oval cross sections. Also, the number of rings may be selected appropriately.

We claim:

1. A holder for securing a microphone or earpiece inside a helmet, ear muff or the like, said holder comprising a plurality of tubular rings of soft flexible material, one ring being adapted to be connected to a shell of the helmet, ear muff or the like, the rings being serially connected by resilient, short, thin, soft segments, the rings being dimensioned and arranged so that they can be nested within each other or pulled out to form an extending holder, there being means to connect a microphone or earpiece to one of said rings; the soft segments having different degrees of hardness, so that certain segments are folded or straightened out in a predetermined sequence when the holder is pushed into the nested position or pulled out to the extending position respectively.

2. A holder according to claim 1 wherein one or more of the rings is provided with acoustically active elements.

3. A holder according to claim 2 wherein said acoustically active elements comprise a plurality of openings.

4. A holder according to claim 1 wherein means are provided for remotely controlling the extension of the holder.

5. A holder according to claim 1 wherein the holder is fabricated in one piece from a soft, flexible material.

6. A holder according to claim 5 wherein the flexible material is rubber.

7. A holder securing a sound transducing member inside a helmet, said holder comprising a plurality of tubular rings of soft flexible material, one ring being adapted to be connected to a shell of the helmet, ear muff or the like, the rings being serially connected by resilient, short, thin, soft segments, the rings being dimensioned and arranged so that they can be nested within each other or pulled out to form an extending holder, there being means to connect said sound transducing member to one of said rings; the soft segments having different degrees of hardness, so that certain segments are folded or straightened out in a predetermined sequence when the holder is pushed into the nested position or pulled out to the extending position respectively.

8. A holder securing a sound transducing member inside an ear muff, said holder comprising a plurality of tubular rings of soft flexible material, one ring being adapted to be connected to a shell of the helmet, ear muff or the like, the rings being serially connected by resilient, short, thin, soft segments, the rings being dimensioned and arranged so that they can be nested within each other or pulled out to form an extending holder, there being means to connect said second transducing member or earpiece to one of said rings; the soft segments having different degrees of hardness, so that certain segments are folded or straightened out in a predetermined sequence when the holder is pushed into the nested position or pulled out to the extending position respectively.

* * * * *